US012624689B1

(12) United States Patent
Tong

(10) Patent No.: US 12,624,689 B1
(45) Date of Patent: May 12, 2026

(54) MODULAR PIEZOELECTRIC CERAMIC PUMP

(71) Applicant: Foshan SD Technology Co., Ltd., Foshan City (CN)

(72) Inventor: Guoping Tong, Foshan City (CN)

( * ) Notice: Subject to any disclaimer, the term of this patent is extended or adjusted under 35 U.S.C. 154(b) by 0 days.

(21) Appl. No.: 18/983,029

(22) Filed: Dec. 16, 2024

(30) Foreign Application Priority Data

Nov. 8, 2024 (CN) ..... 202422719593.9

(51) Int. Cl.

| | |
|---|---|
| ***F04B 35/04*** | (2006.01) |
| ***F04B 39/12*** | (2006.01) |
| ***F04B 41/06*** | (2006.01) |
| ***F04B 43/04*** | (2006.01) |

(52) U.S. Cl.
CPC ..... *F04B 35/04* (2013.01); *F04B 39/121* (2013.01); *F04B 41/06* (2013.01); *F04B 43/046* (2013.01)

(58) Field of Classification Search
CPC ..... F04B 35/04; F04B 39/121; F04B 41/06; F04B 43/043; F04B 43/046; F04B 43/095; F04B 45/047; F04B 45/067; F04B 17/003; F04B 19/006
See application file for complete search history.

(56) References Cited

U.S. PATENT DOCUMENTS

| | | | | |
|---|---|---|---|---|
| 2,928,409 | A * | 3/1960 | Johnson | G05D 16/028 91/363 R |
| 9,989,047 | B2 * | 6/2018 | Chen | F04B 45/047 |
| 2009/0242060 | A1 * | 10/2009 | Chen | F04B 43/046 137/814 |
| 2011/0280755 | A1 * | 11/2011 | Wackerle | F04B 43/046 417/559 |

* cited by examiner

*Primary Examiner* — Loren C Edwards
(74) *Attorney, Agent, or Firm* — Sandy Lipkin

(57) ABSTRACT

The present invention provides a modular piezoelectric ceramic pump comprising a casing with an air inlet port and an air outlet port, and pump core components, wherein more than two pump core components are provided and stacked in the casing; in each pump core component, a conducting component is connected to a piezoelectric ceramic plate connected to an external power supply driving the piezoelectric ceramic plate to vibrate, thereby driving gas to flow into an air cavity and to be discharged from the air cavity; the air inlet port is connected to the air inlet of the top pump core component, and the air outlet port is connected to the air outlet of the bottom pump core component. Different numbers of pump core components can be assembled according to required output pressure of a pump body or required range of flow rate to provide greater transmission power.

7 Claims, 7 Drawing Sheets

MODULAR PIEZOELECTRIC CERAMIC PUMP

REFERENCE TO PRIOR APPLICATION

This application claims priority to Chinese Patent Application 202422719593.9, filed on Nov. 8, 2024, which is incorporated herein by reference.

TECHNICAL FIELD

The present invention belongs to the technical field of air pumps, and more specifically, particularly relates to a modular piezoelectric ceramic pump.

BACKGROUND

As the requirements for pump body usage scenarios by people become higher and higher, piezoelectric ceramic pumps with advantages of small volume and low noise are gradually being widely used in home appliances and personal care products.

However, since the traditional piezoelectric ceramic pumps adopt single-layer laminated ceramic structures, and the air outlet pressure and air outlet flow rate are generally small, the traditional piezoelectric ceramic pumps are difficult to be widely used in scenarios where the requirement on pump body output power is high and the pump operating power adjustment range is wide. It is usually necessary to configure pump structures of different sizes and shapes based on different application scenarios. Therefore, providing a piezoelectric ceramic pump that can be applied to high power requirements and can adapt to the power adjustment range is a problem that urgently needs to be solved in the field.

SUMMARY

In order to solve the aforementioned technical problems, the present invention provides a modular piezoelectric ceramic pump to solve the problems in the prior art that the piezoelectric ceramic pumps are low in air outlet pressure and small in air flow and cannot meet the needs of a wide range of power adjustment.

The purpose and effect of the modular piezoelectric ceramic pump of the present invention are achieved by the following specific technical means:

A modular piezoelectric ceramic pump comprises a casing provided with an air inlet port and an air outlet port, and pump core components arranged in the casing, wherein each pump core component comprises a pump core support, a conducting component, a piezoelectric ceramic plate, an air inlet valve body plate, and an air outlet valve body plate; the piezoelectric ceramic plate, the air inlet valve body plate, and the air outlet valve body plate are stacked in sequence, so that an air cavity is formed between the piezoelectric ceramic plate and the air outlet valve body plate; the air inlet valve body plate is provided with an air inlet, and the air outlet valve body plate is provided with an air outlet; more than two pump core components are provided and stacked in the casing, and the orientations of the air inlet and the air outlet of each pump core component are the same; the conducting component is electrically connected to the piezoelectric ceramic plate; the piezoelectric ceramic plate is connected to an external power supply through the conducting component; the external power supply drives the piezoelectric ceramic plate to vibrate, thereby driving gas to flow into an air cavity through an air inlet and to be discharged from the air cavity through an air outlet; the air inlet port is connected to the air inlet of the top pump core component, and the air outlet port is connected to the air outlet of the bottom pump core component.

Compared with the prior art, the present invention has the following beneficial effects: due to the modular design of the pump core components, in different application scenarios, different numbers of pump core components can be selectively assembled according to required output pressure and flow of a pump body and required range of power adjustment. The modular piezoelectric ceramic pump has the advantages of wide application range and simplicity.

Further, the casing comprises an upper casing and a lower casing; the shape of the pump core support is adapted to the shape of the casing; the pump core components are stacked and sandwiched between the upper casing and the lower casing; adjacent pump core components are abutted against each other via the pump core support to form a sealed connection; the pump core component adjacent to the upper casing is abutted against the lower end surface of the upper casing via the pump core support to form a sealed connection; the pump core component adjacent to the lower casing is abutted against the upper end surface of the lower casing via the pump core support to form a sealed connection. The matching structure of the upper casing and the lower casing can realize the assembly of other pump core components by welding, gluing and the like, and the structure is simple and has high adaptability.

Further, a through hole is formed in the middle of the air inlet valve body plate; the piezoelectric ceramic plate covers the through hole; the air inlet is arranged around the periphery of the coverage area of the piezoelectric ceramic plate. The arrangement of a through hole structure enables the pump core component to have a larger air cavity with the same volume.

Further, the air inlet valve body plate is flexibly connected to the pump core support or the air outlet valve body plate. The piezoelectric ceramic plate can drive the air inlet valve body plate to vibrate to a certain extent when vibrating, so that the overall deformation range of the air cavity of the pump core component is wider and the output air pressure and airflow are greater.

Further, raised portion is arranged in the middle of the air inlet valve body plate, and the through hole and/or air inlet is formed in the raised portion. The design of the raised portion enables the pump core component to have a larger air cavity with the same volume.

Further, the rigidity of the raised portion of the air inlet valve body plate is smaller than that of the peripheral area of the air inlet valve body plate. The raised portion can be formed by two independent components, namely the air inlet valve body plate body and the middle-raised portion, or by integrally stamping the middle of the air inlet valve body plate. Since the raised portion is a mating portion with the piezoelectric ceramic plate, the area is made of a material with lower rigidity, which is more conducive to driving the vibration during the vibration of the piezoelectric ceramic plate, thereby making the overall deformation range of the air cavity of the pump core component wider and the output air pressure and airflow greater.

Further, the pump core support is provided with a conducting through hole, and the conducting component penetrates the conducting through hole and is flexibly connected to the piezoelectric ceramic plate, so that the limitation of the conducting component on the vibration of the piezoelectric ceramic plate is reduced.

Further, the conducting component and the conducting through hole are flexibly matched, so that the vibration of the conducting component driven by the piezoelectric ceramic plate during the vibration and the affecting to the airtightness between the conducting component and the conducting through hole are avoided.

Further, the air inlet valve body plate is made of a conducting material, and the conducting component is electrically connected to the piezoelectric ceramic plate by being connected to the air inlet valve body plate. Since the piezoelectric ceramic plate needs to be connected to both the positive and negative electrodes at the same time, and one of the electrodes is connected through the air inlet valve body plate, the number of connecting components to the piezoelectric ceramic plate can be reduced, and the limitation to vibration of the piezoelectric ceramic plate can be effectively reduced.

Further, the casing is a metal casing, the rigidity requirement of the entire pump body is guaranteed.

Figure 1:
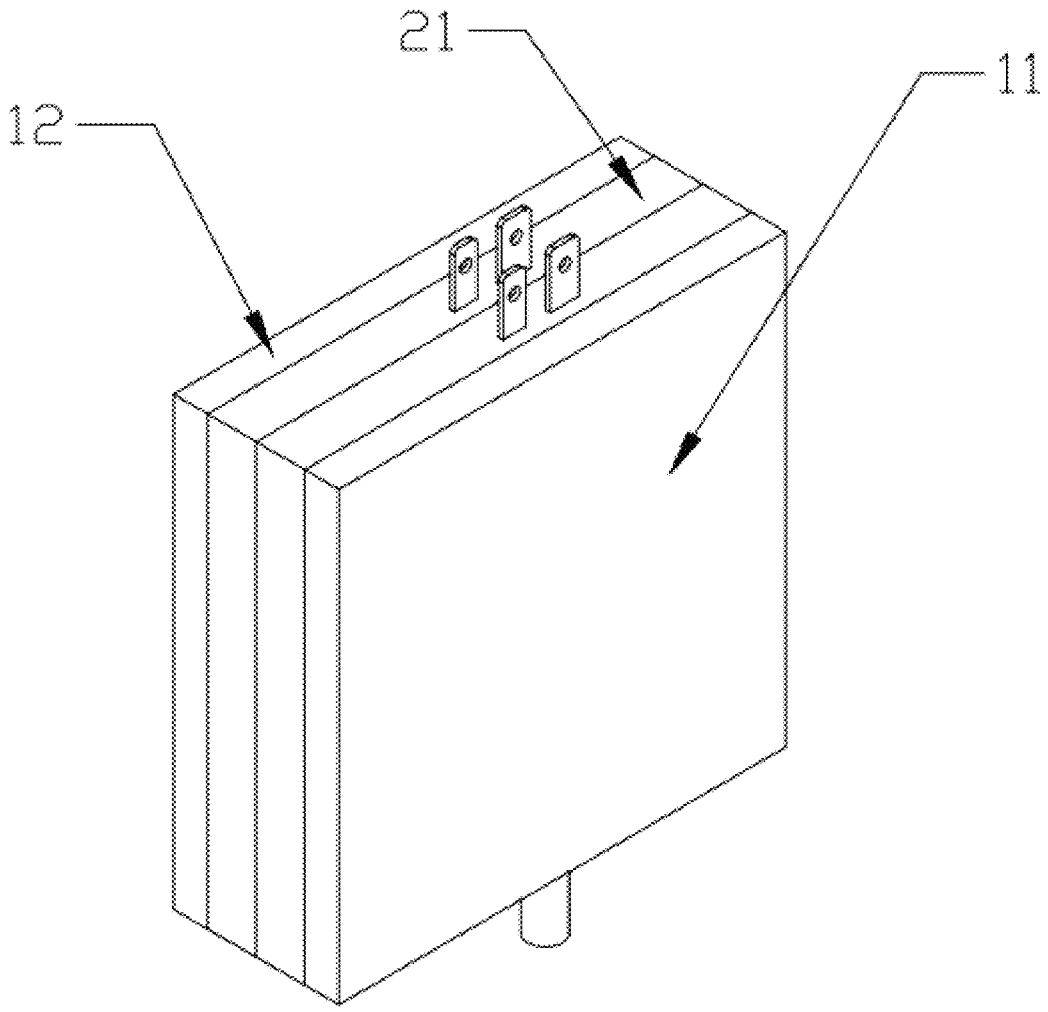
FIG. 1 is a structural schematic diagram of a modular piezoelectric ceramic pump of the present invention.

In the figures, the corresponding relationship between the component names and the drawing numbers is as follows:

11, upper casing; 12, lower casing; 21, pump core support; 22, conducting component; 23, piezoelectric ceramic plate; 24, air inlet valve body plate; 25, air outlet valve body plate; 26, air inlet; 27, air outlet.

DETAILED DESCRIPTION OF EMBODIMENTS

The implementation method of the present invention is further described in details below in conjunction with the drawings and embodiment. The following embodiment is used to illustrate the present invention but cannot be used to limit the range of the present invention.

Embodiment

As shown in FIGS. 1 to 7:

A modular piezoelectric ceramic pump comprises a casing and pump core components arranged in the casing, wherein the casing is provided with an air inlet port and an air outlet port, so that the casing forms a breathing channel, ensuring smooth inflow and outflow of gas. Each pump core component comprises a pump core support 21, a conducting component 22, a piezoelectric ceramic plate 23, an air inlet valve body plate 24, and an air outlet valve body plate 25, wherein the piezoelectric ceramic plate 23, the air inlet valve body plate 24, and the air outlet valve body plate 25 are stacked in sequence, and the combination thereof forms an air cavity between the piezoelectric ceramic plate 23 and the air outlet valve body plate 25. A plurality of groups of air inlet 26 are formed in the air inlet valve body plate 24; air outlets 27 are formed in the air outlet valve body plate 25; the air inlets and air outlets are key paths for gas flow. More than two pump core components are provided, and the number of pump core components is increased or decreased according to usage requirements. The pump core components are regularly stacked in the casing, and orientations of the air inlet 26 and the air outlet 27 of each pump core component are the same, ensuring that the flow direction of the gas in the entire pump is stable and orderly. The conducting component 22 is electrically connected to the piezoelectric ceramic plate 23, and the piezoelectric ceramic plate 23 can be connected to an external power supply through the conducting component 22. When the external power supply starts to work, the external power supply drives the piezoelectric ceramic plate 23 to vibrate. The gas first flows into the air cavity through the air inlet 26, and then is discharged from the air cavity through the air outlet 27 under the action of vibration, forming a complete gas flow cycle. The air inlet port in the casing is connected to the air inlet 26 of the top pump core component, and the air outlet port is connected to an air outlet 27 of the bottom pump core component, so that the getting in and out of the gas of the entire pump form a unified system, and the stable and efficient operation of the pump is guaranteed.

Figure 2:
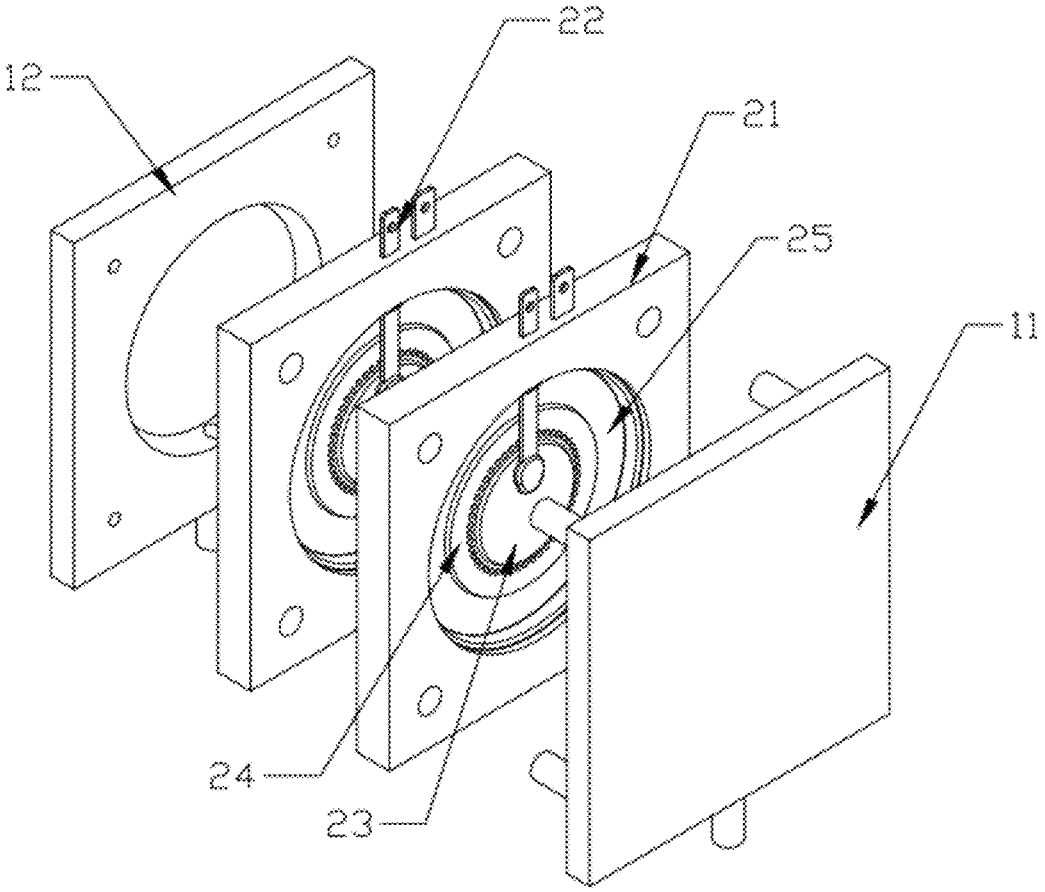
FIG. 2 is an exploded view of a modular piezoelectric ceramic pump of the present invention.
Figure 3:
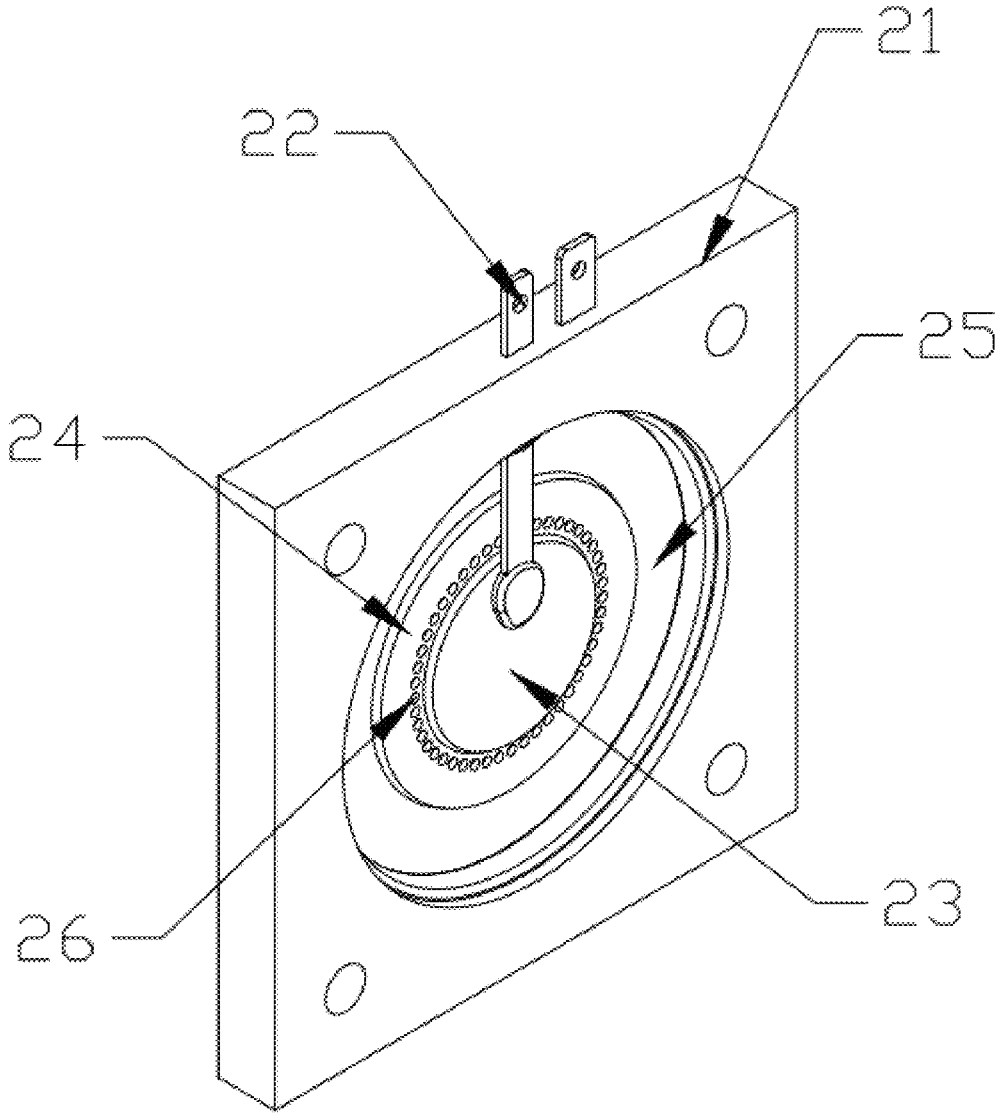
FIG. 3 is a front view of a first state of the assembled pump core component in a modular piezoelectric ceramic pump of the present invention.
Figure 4:
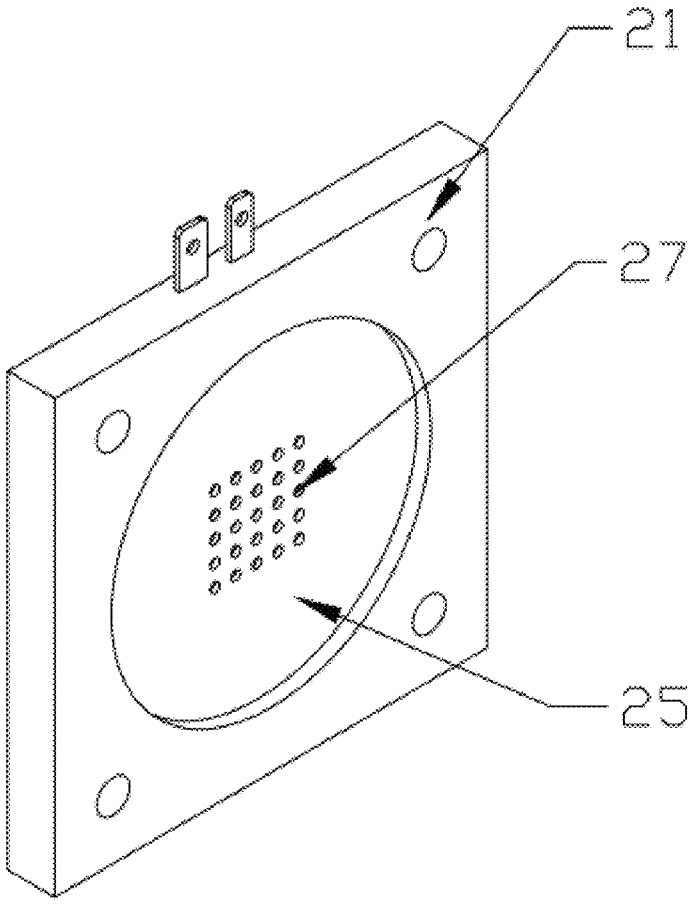
FIG. 4 is a rear view of the assembled pump core component in a modular piezoelectric ceramic pump of the present invention.
Figure 5:
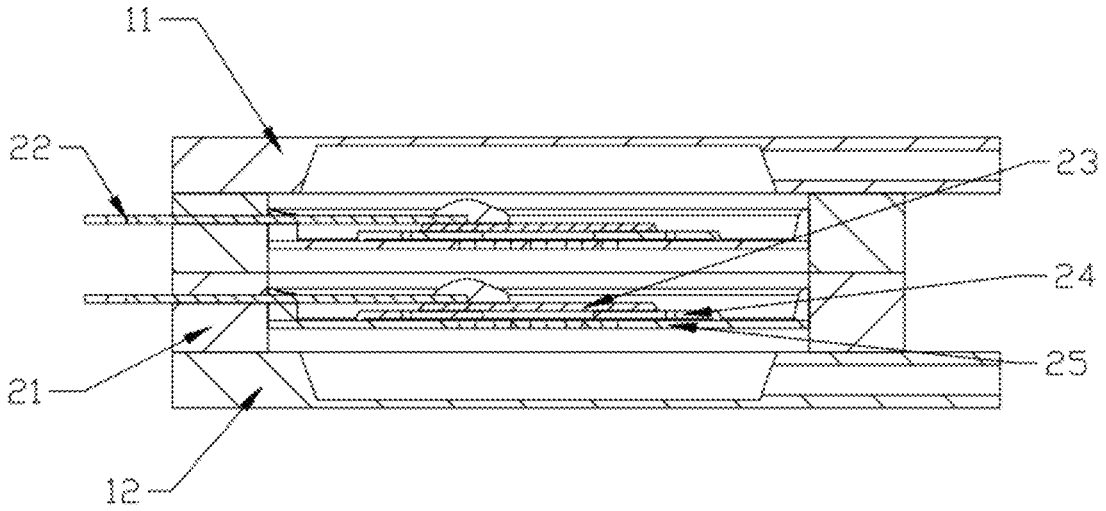
FIG. 5 is a cross-sectional view of a modular piezoelectric ceramic pump of the present invention.

Refer to FIG. 2, FIG. 3 and FIG. 5, the casing comprises an upper casing 11 and a lower casing 12, which provide stable accommodation space for key components inside. The shape of the pump core support 21 is adapted to the shape of the casing, so that the compactness and stability of the entire device structure are guaranteed. The plurality of pump core components are stacked and regularly sandwiched between the upper casing 11 and the lower casing 12. Adjacent pump core components are connected via pump core support 21 and abutted against each other to form a sealed connection. The pump core component adjacent to the upper casing 11 is tightly abutted against the lower end surface of the upper casing 11 through the pump core support 21, thereby forming a reliable sealed connection; similarly, the pump core component adjacent to the lower casing 12 is also abutted against the upper end surface of the lower casing 12 through the pump core support 21, thereby achieving good sealing effect.

A through hole is formed in the middle of the air inlet valve body plate 24; the piezoelectric ceramic plates 23 covers the through hole, and the piezoelectric ceramic plates and the through hole fit together perfectly. The air inlets 26 are distributed in a ring shape in the periphery of the area covered by the piezoelectric ceramic plate 23, so that the gas can flow in around the piezoelectric ceramic plate 23 in an orderly manner when entering. The air inlet valve body plate 24 is flexibly connected to the pump core support 21 or the air outlet valve body plate 25. The flexible connection can adopt glue pouring or sealing, not only ensures the relative stability of the position of the air inlet valve body plate 24 during the operation of the pump body, but also forms a certain buffer space when the air inlet valve body plate is affected by certain external force or internal vibration, thereby avoiding damage to components that may be caused by rigid connection, ensuring the stable operation of the entire pump core component and the entire piezoelectric ceramic pump, and extending the service life. The air inlet valve body plate 24 has certain flexibility in design and can be formed into two states; the first state is set so that the edge of the air inlet valve body plate 24 is away from the pump core support 21, so that the air inlet valve body plate cannot contact with the potting glue or sealing glue.

Figure 6:
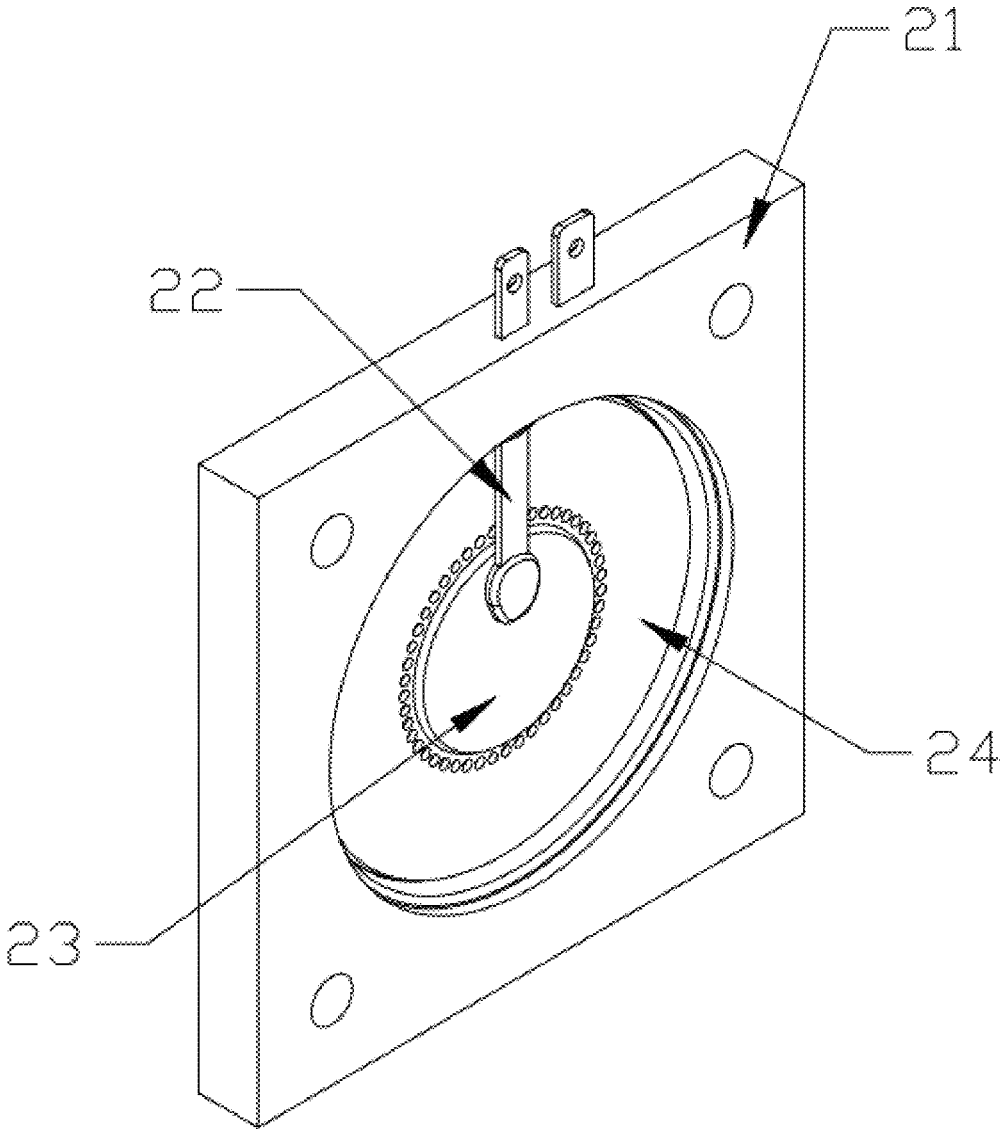
FIG. 6 is a front view of a second state of the assembled pump core component in a modular piezoelectric ceramic pump of the present invention.
Figure 7:
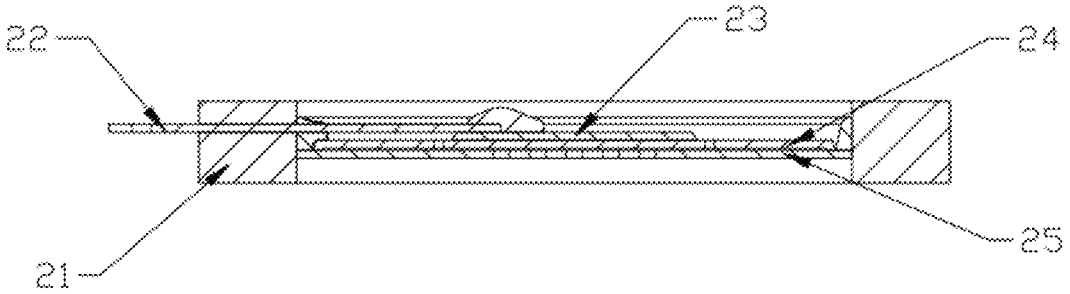
FIG. 7 is a cross-sectional view of a second state of the assembled pump core component in a modular piezoelectric ceramic pump of the present invention.

Refer to FIG. 6 and FIG. 7, the second state is set so that the edge of the air inlet valve body plate 24 is close to the pump core support 21, so that the edge of the is in contact with the potting glue or sealing glue, and the area of the edge of the air inlet valve body plate 24 is larger. As the area increases, the flexibility of the middle of the air inlet valve body plate 24 becomes stronger, thereby creating more favorable conditions for the stable operation of the entire equipment and efficient gas transmission.

Refer to FIG. 2 and FIG. 3, a raised portion is arranged in the middle of the air inlet valve body plate 24, and the through hole and/or air inlet 26 is formed in the raised portion, so that the gas can enter in orderly and efficient manner. Moreover, the rigidity of the raised portion of the air inlet valve body plate 24 is smaller than that of the peripheral area of the air inlet valve body plate, so that the raised portion is more flexible during the operation of the pump body and can better adapt to internal pressure change and vibration, and the smoothness of gas flow is guaranteed.

The pump core support 21 is provided with a conducting through hole, and the conducting component 22 penetrates the conducting through hole and is flexibly connected to the piezoelectric ceramic plate 23, so that stable transmission of electric energy is guaranteed, effective buffer can be provided for the pump body during vibration, and loose connection or damage are avoided. At the same time, the conducting component 22 and the conducting through hole are also flexibly matched, so that the stability and adaptability of the entire connection are further enhanced.

The air inlet valve body plate 24 is made of a conducting material, and the conducting component 22 is electrically connected to the piezoelectric ceramic plate 23 by being connected to the air inlet valve body plate 24, ensuring that the piezoelectric ceramic plate 23 can stably obtain energy from an external power supply and further drive the pump body to work normally.

The casing is a metal casing, which gives the casing a strong and durable characteristic, and provides reliable protection for the internal components to prevent the components from being disturbed and damaged by external environment.

The embodiment of the present invention is presented for purposes of illustration and description, and is not intended to be exhaustive or to limit the present invention to the form disclosed. Many modifications and variations will be apparent to those of ordinary skill in the art. The embodiment is selected and described in order to better illustrate the principle and practical application of the present invention and to enable those skilled in the art to understand the present invention and thereby design various embodiments with various modifications suitable for specific purposes.

What is claimed is:

1. A modular piezoelectric ceramic pump, characterized by comprising a casing provided with an air inlet port and an air outlet port, and pump core components arranged in the casing;

wherein each of the pump core components comprises a pump core support (21), a conducting component (22), a piezoelectric ceramic plate (23), an air inlet valve body plate (24), and an air outlet valve body plate (25);

the piezoelectric ceramic plate (23), the air inlet valve body plate (24), and the air outlet valve body plate (25) are stacked in sequence, so that an air cavity is formed between the piezoelectric ceramic plate (23) and the air outlet valve body plate (25); the air inlet valve body plate (24) is provided with an air inlet (26), and the air outlet valve body plate (25) is provided with an air outlet (27);

more than two of the pump core components are provided and stacked in the casing, and the orientations of the air inlet (26) and the air outlet (27) of each of the pump core component are the same;

in each of the pump core components the respective conducting component (22) is electrically connected to the respective piezoelectric ceramic plate (23); an external power supply is connected to the respective piezoelectric ceramic plate (23) of each of the pump core components through the respective conducting component (22) of each of the pump core components; the external power supply drives each of the piezoelectric ceramic plates (23) to vibrate, thereby driving gas to flow into each of the air cavities through the air inlet (26) and driving the gas to be discharged from each of the air cavities through the air outlet (27);

the air inlet port is connected to the air inlet (26) of a top pump core component of the more than two pump core components, and the air outlet port is connected to the air outlet (27) of a bottom pump core component of the more than two pump components;

further characterized in that, in each of the pump core components, that a through hole is formed in a middle of the respective air inlet valve body plate (24); the respective piezoelectric ceramic plate (23) covers the respective through hole; the respective air inlet (26) is arranged around a periphery of a coverage area of the respective piezoelectric ceramic plate (23)

further characterized in that, in each of the pump core components, a raised portion is arranged in the middle of the respective air inlet valve body plate (24), and the respective through hole and/or the respective air inlet (26) is formed in the raised portion further characterized in that, in each of the pump core components, the rigidity of the raised portion of the respective air inlet valve body plate (24) is smaller than a rigidity of the peripheral area of the respective air inlet valve body plate (24).

2. The modular piezoelectric ceramic pump according to claim 1, further characterized in that the casing comprises an upper casing (11) and a lower casing (12); a shape of each of the pump core supports (21) is adapted to the shape of the casing; the pump core components are stacked and sandwiched between the upper casing (11) and the lower casing (12);

adjacent pump core components of the more than two pump core components are abutted against each other via the respective pump core support (21) to form a sealed connection; the pump core component adjacent to the upper casing (11) is abutted against a lower end surface of the upper casing (11) via the respective pump core support (21) to form the sealed connection; the pump core component adjacent to the lower casing (12) is abutted against an upper end surface of the lower casing (12) via the respective pump core support (21) to form the sealed connection.

3. The modular piezoelectric ceramic pump according to claim 1, further characterized in that, in each of the pump core components the respective air inlet valve body plate (24) is flexibly connected to the respective pump core support (21) or the respective air outlet valve body plate (25).

4. The modular piezoelectric ceramic pump according to claim 1, further characterized in that, in each of the pump core components, the pump core support (21) is provided with a conducting through hole, and the respective conducting component (22) penetrates the respective conducting through hole and is flexibly connected to the respective piezoelectric ceramic plate (23).

5. The modular piezoelectric ceramic pump according to claim 4, further characterized in that, in each of the pump core components, the respective conducting component (22) and the respective conducting through hole are flexibly matched.

6. The modular piezoelectric ceramic pump according to claim 1, further characterized in that, in each of the pump core components, the respective air inlet valve body plate (24) is made of a conducting material, and the respective conducting component (22) is electrically connected to the respective piezoelectric ceramic plate (23) by being connected to the respective air inlet valve body plate (24).

7. The modular piezoelectric ceramic pump according to claim 1, further characterized in that the casing is a metal casing.

* * * * *